US011002236B2

(12) United States Patent
Saito et al.

(10) Patent No.: US 11,002,236 B2
(45) Date of Patent: May 11, 2021

(54) HIGH-PRESSURE FUEL SUPPLY PUMP

(71) Applicant: Hitachi Automotive Systems, Ltd., Hitachinaka (JP)

(72) Inventors: Atsuji Saito, Hitachinaka (JP); Satoshi Usui, Hitachinaka (JP); Minoru Hashida, Hitachinaka (JP); Masayuki Suganami, Hitachinaka (JP); Hiroyuki Yamada, Hitachinaka (JP); Kenichiro Tokuo, Hitachinaka (JP); Masamichi Yagai, Hitachinaka (JP); Yuta Saso, Hitachinaka (JP)

(73) Assignee: HITACHI AUTOMOTIVE SYSTEMS, LTD., Hitachinaka (JP)

( * ) Notice: Subject to any disclaimer, the term of this patent is extended or adjusted under 35 U.S.C. 154(b) by 0 days.

(21) Appl. No.: 16/342,278

(22) PCT Filed: Oct. 26, 2017

(86) PCT No.: PCT/JP2017/038633
§ 371 (c)(1),
(2) Date: Apr. 16, 2019

(87) PCT Pub. No.: WO2018/092538
PCT Pub. Date: May 24, 2018

(65) Prior Publication Data

US 2019/0323465 A1 Oct. 24, 2019

(30) Foreign Application Priority Data

Nov. 18, 2016 (JP) ..... JP2016-224632

(51) Int. Cl.
*F02M 59/44* (2006.01)
*F02M 59/34* (2006.01)
*F02M 59/36* (2006.01)

(52) U.S. Cl.
CPC ..... *F02M 59/44* (2013.01); *F02M 59/34* (2013.01); *F02M 59/36* (2013.01)

(58) Field of Classification Search
CPC ..... F02M 59/44; F02M 59/34; F02M 59/36; F04B 23/02; F04B 23/103; F04B 11/0033; F04B 1/053; F04B 1/0404
See application file for complete search history.

(56) References Cited

U.S. PATENT DOCUMENTS 7,336,316 B2 2/2008 Fazzini
2005/0036061 A1 2/2005 Fazzini
(Continued)

FOREIGN PATENT DOCUMENTS

EP 3088725 A1 11/2016
JP 2006-525713 A 11/2006
(Continued)

OTHER PUBLICATIONS

International Search Report with English translation and Written Opinion issued in corresponding application No. PCT/JP2017/038633 dated Feb. 13, 2018.
(Continued)

*Primary Examiner* — Xiao En Mo
(74) *Attorney, Agent, or Firm* — Foley & Lardner LLP

(57) ABSTRACT

An object of the present invention is to supply a high-pressure fuel supply pump capable of holding a spring holding member while reducing the height of the pump body.

A high-pressure fuel supply pump is provided with a pump body for forming a pressurizing chamber at an inner wall portion, and a flange portion for fixing the pump body to a high-pressure fuel supply pump mounting portion. The high-pressure fuel supply pump is provided with a cylinder and a spring holding member. The cylinder is inserted into
(Continued)

a hole portion of the pump body from a lower side and in which the pressurizing chamber is formed further above an uppermost end surface. The spring holding member has an outer peripheral portion press-fitted and fixed to the pump body and a holding portion holding a spring portion for biasing the pump body between the outer peripheral portion and the inner peripheral portion. A spring-side lowest end portion of the holding surface of the spring holding member is disposed above the lowermost end portion of the flange portion.

17 Claims, 4 Drawing Sheets

(56) References Cited

U.S. PATENT DOCUMENTS

| | | | | |
|---|---|---|---|---|
| 2007/0171302 | A1 | 7/2007 | Fazzini | |
| 2015/0017039 | A1* | 1/2015 | Usui | F02M 59/44 417/505 |
| 2015/0300338 | A1 | 10/2015 | Aritomi | |
| 2016/0312775 | A1 | 10/2016 | Saso et al. | |
| 2017/0037822 | A1 | 2/2017 | Yagai | |

FOREIGN PATENT DOCUMENTS

| | | | |
|---|---|---|---|
| JP | 2008-525713 | A | 7/2008 |
| JP | 2013-174191 | A | 9/2013 |
| JP | 2014-088838 | A | 5/2014 |
| JP | 2016-094913 | A | 5/2016 |
| WO | WO-2015/163245 | A1 | 10/2015 |

OTHER PUBLICATIONS

Office Action issued in corresponding Japanese Patent Application No. 2018-551547 dated Oct. 6, 2020, with English machine translation.

Supplementary Partial European Search Report issued in corresponding European Patent Application No. 17872077.7 dated May 25, 2020.

Extended European Search Report issued in corresponding European Patent Application No. 17872077.7 dated Jul. 7, 2020.

* cited by examiner

HIGH-PRESSURE FUEL SUPPLY PUMP

TECHNICAL FIELD

The present invention relates to a high-pressure fuel supply pump for pumping fuel to a fuel injection valve of an internal combustion engine.

BACKGROUND ART

PTL 1 discloses a conventional technique of the high-pressure fuel pump of the present invention. Paragraphs 0031 to 0033 and FIGS. 1 to 4 of PTL 1 describes as follows:

The cylinder 6 in Paragraph (0031) has a large diameter portion and a small diameter portion at its outer diameter, the small diameter portion is press-fitted into a pump body 1 and a step 6*a* between the large diameter portion and the small diameter portion is pressed against a surface of the pump body 1 and seals leakage of fuel pressurized in a pressurizing chamber 11 to a low pressure side. At the lower end of the plunger 2 in Paragraph (0032), a tappet 3 is provided for converting rotational motion of a cam 5 attached to a camshaft of the internal combustion engine into up-and-down motion and transmitting the motion to the plunger 2. The plunger 2 is crimped to the tappet 3 by a spring 4 via a retainer 15. As a result, the plunger 2 can move (reciprocate) up and down along with the rotational motion of the cam 5. Further in Paragraph (0033), the plunger seal 13 held at the lower end portion of the inner periphery of the seal holder 7 is disposed in slidable contact with the outer periphery of the plunger 2 at the lower end portion of the cylinder 6 in the drawing. Thus, a blow-by gap between the plunger 2 and the cylinder 6 is sealed to prevent fuel from leaking to the outside of the pump. At the same time, it prevents a lubricant (including engine oil) lubricating the sliding portion in the internal combustion engine from flowing into the pump body 1 through the blow-by gap.

CITATION LIST

Patent Literature

PTL 1: WO 2015/163245 A

SUMMARY OF INVENTION

Technical Problem

A high-pressure fuel supply pump is mounted in a hole provided in a cylinder block of an engine.

Since various parts are attached to this cylinder block, it is desirable that there be no room in a space, and it be as small as possible.

Accordingly, an object of the present invention is to supply a high-pressure fuel supply pump capable of holding a spring holding member while reducing the height of the pump body.

Solution to Problem

In order to achieve the above object, a high-pressure fuel supply pump is provided with a pump body for forming a pressurizing chamber at an inner wall portion, and a flange portion for fixing the pump body to a high-pressure fuel supply pump mounting portion. The high-pressure fuel supply pump is provided with a cylinder and a spring holding member. The cylinder is inserted into a hole portion of the pump body from a lower side and in which the pressurizing chamber is formed further above an uppermost end surface. The spring holding member has an outer peripheral portion press-fitted and fixed to the pump body and a holding portion holding a spring portion for biasing the pump body between the outer peripheral portion and the inner peripheral portion. A spring-side lowest end portion of the holding surface of the spring holding member is disposed above the lowermost end portion of the flange portion.

Advantageous Effects of Invention

According to the present invention, it is possible to supply a high-pressure fuel supply pump capable of holding a spring holding member while reducing the height of a pump body.

Other constitutions, actions, and effects of the present invention will be described in detail in the following embodiments.

DESCRIPTION OF EMBODIMENTS

Embodiments of the present invention will be described below with reference to the drawings.

EMBODIMENTS

First, a first embodiment of the present invention will be described in detail with reference to the drawings.

Figure 3:
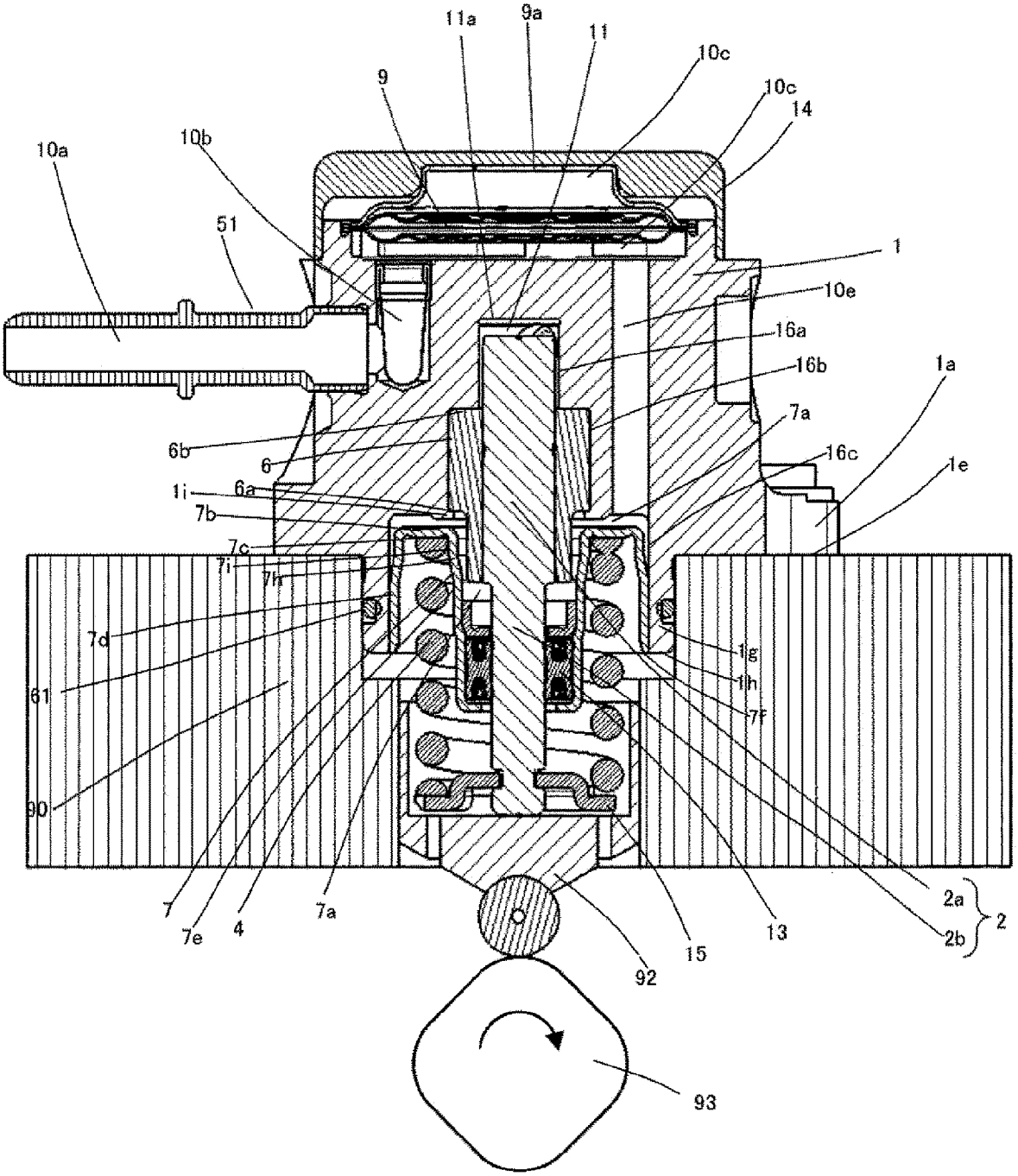
FIG. 3 is a longitudinal sectional view of the high-pressure fuel supply pump according to the embodiment of the present invention as viewed from a different direction from FIG. 1.
Figure 4:
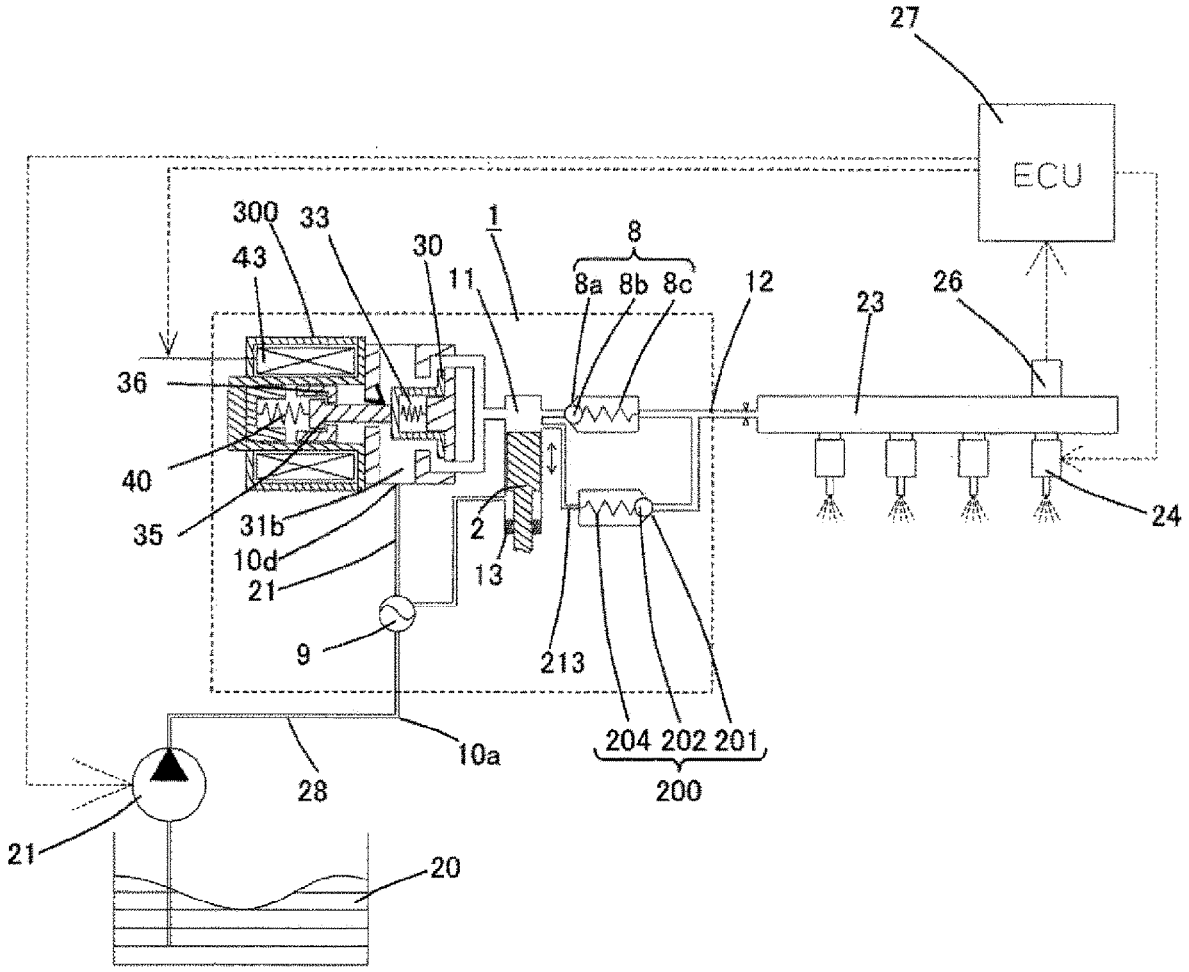
FIG. 4 is a configuration diagram of an engine system to which the high-pressure fuel supply pump according to the embodiment of the present invention is applied.

FIG. 4 shows an overall configuration view of an engine system. The part surrounded by the broken line shows the main body of the high-pressure fuel supply pump (hereinafter referred to as a high-pressure fuel supply pump), and the mechanism/parts in this broken line indicate that those are integrally incorporated in a pump body 1. Hereinafter, the present embodiment will be described with reference to a sectional view of the high-pressure fuel supply pump illustrated in FIGS. 4 and 1 to 3.

Fuel in a fuel tank 20 is pumped up by a feed pump 21 based on a signal from an engine control unit 27 (hereinafter referred to as an ECU). This fuel is pressurized to an appropriate feed pressure and sent to a low pressure fuel suction port 10*a* of the high-pressure fuel supply pump through a suction pipe 28.

Fuel that has passed through a suction joint 51 from the low-pressure fuel suction port 10*a* reaches a suction port 31*b* of an electromagnetic suction valve mechanism 300 included in a capacity variable mechanism via a pressure pulsation reduction mechanism 9, and a suction passage 10*d*.

Fuel which has flown into the electromagnetic suction valve mechanism 300 passes through an intake port opened and closed by a suction valve 30 and flows into the pressurizing chamber 11. Power to reciprocate a plunger 2 is given by a cam mechanism 93 of an engine. Due to the reciprocating motion of the plunger 2, fuel is sucked from the suction valve 30 in the descending stroke of the plunger 2, and the fuel is pressurized in the rising stroke. Fuel is pumped through a discharge valve mechanism 8 to a common rail 23 on which a pressure sensor 26 is mounted. Based on the signal from the ECU 27, an injector 24 injects fuel to the engine. The present embodiment is a high-pressure fuel supply pump applied to a so-called direct injection engine system in which the injector 24 injects fuel directly into a cylinder of the engine.

The high-pressure fuel supply pump discharges fuel flow by a signal from the ECU 27 to the electromagnetic suction valve mechanism 300 such that the fuel flow is at a desired supply rate.

Figure 1:
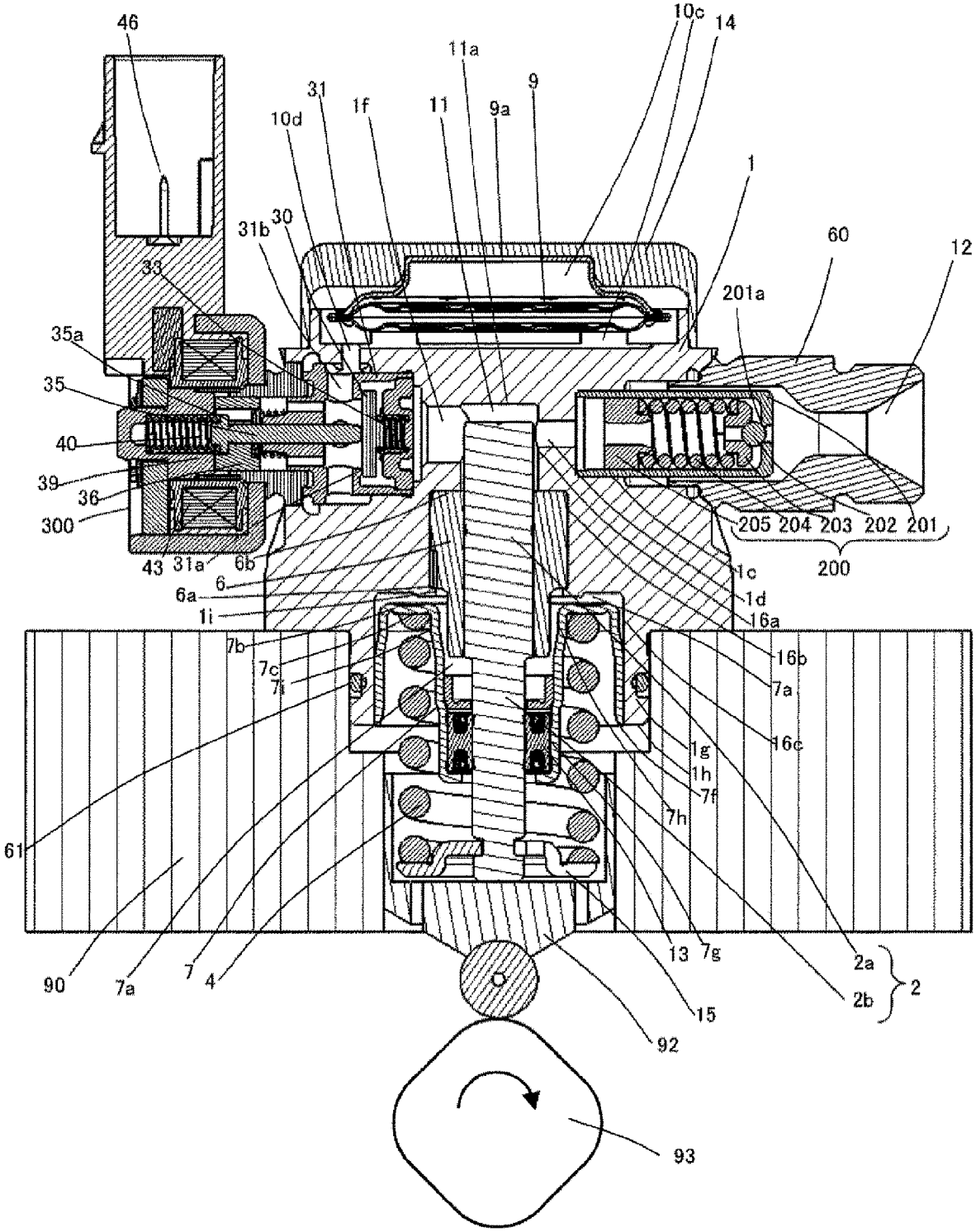
FIG. 1 is a longitudinal sectional view of a high-pressure fuel supply pump according to an embodiment of the present invention.
Figure 2:
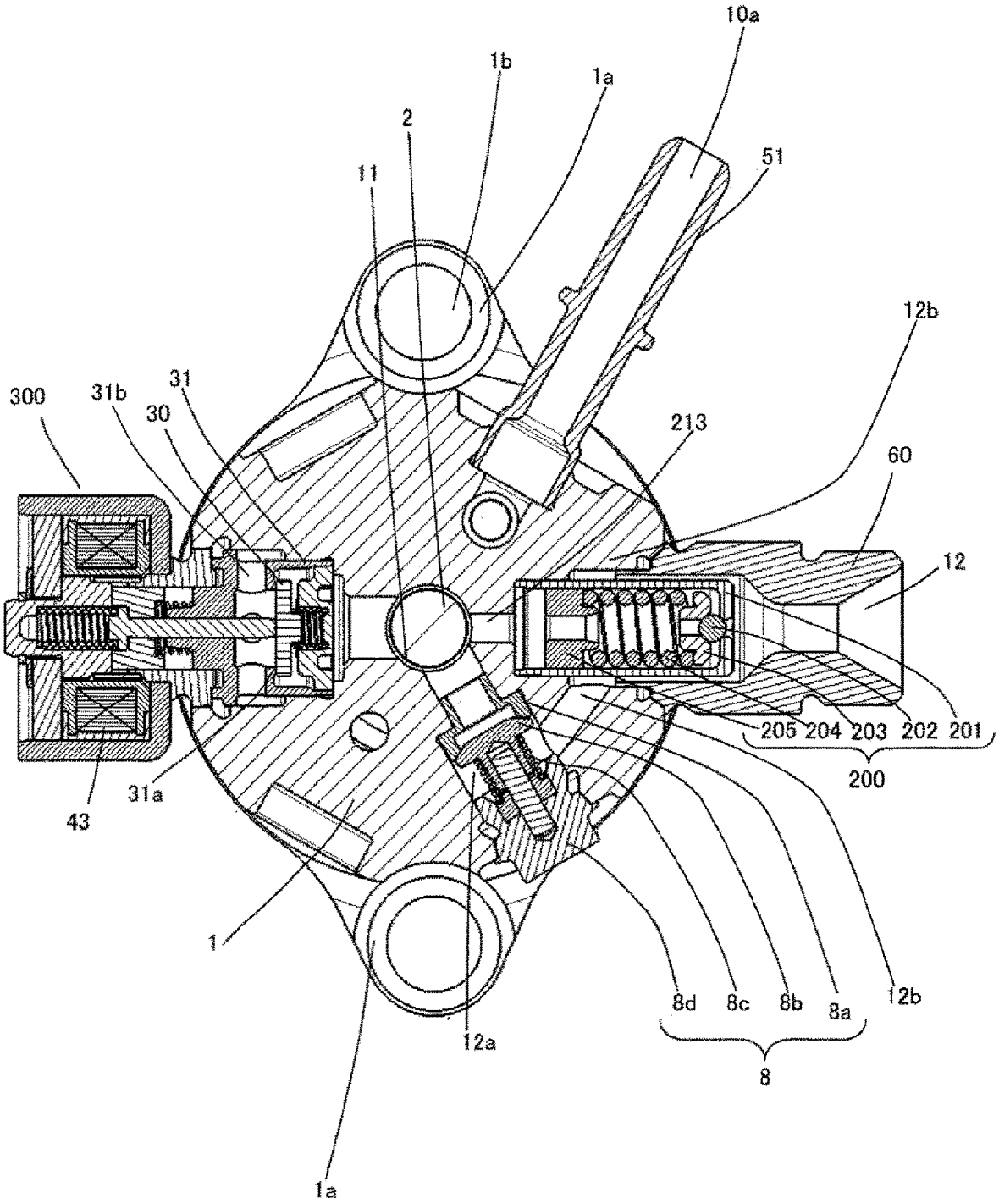
FIG. 2 is a horizontal sectional view of the high-pressure fuel supply pump according to the embodiment of the present invention as viewed from above.

FIG. 1 is a longitudinal sectional view of a high-pressure fuel supply pump according to the present embodiment. FIG. 2 is a horizontal cross-sectional view of the high-pressure fuel supply pump as viewed from above. Further, FIG. 3 is a longitudinal sectional view of the high-pressure fuel supply pump as viewed from a different direction from FIG. 1. In this embodiment, for the sake of convenience, the vertical direction of the high-pressure fuel supply pump is defined with reference to FIG. 1. In other words, the cylinder block side of the engine is a downward direction, and the direction of a damper cover 14 opposite to this is called an upward direction.

As illustrated in FIGS. 1 and 3, the high-pressure fuel supply pump of the present embodiment is fixed in close contact with a high-pressure fuel supply pump mounting portion 90 of an internal combustion engine. Specifically, a screw hole 1*b* is formed in a mounting flange 1*a* provided in the pump body 1 of FIG. 2, and by inserting a plurality of bolts into the mounting flange 1*a*, the mounting flange 1*a* is brought into close contact with and fixed to the high-pressure fuel supply pump mounting portion 90 of the internal combustion engine.

To seal between the high-pressure fuel supply pump mounting portion 90 and the pump body 1, an O-ring 61 is fitted into the pump body 1 to prevent an engine oil from leaking to the outside.

The cylinder 6 for guiding the reciprocating motion of the plunger 2 and forming the pressurizing chamber 11 together with the pump body 1 is attached to the pump body 1. In other words, the plunger 2 reciprocates inside the cylinder to change the volume of the pressurizing chamber. The electromagnetic suction valve mechanism 300 for supplying fuel to the pressurizing chamber 11, and the discharge valve mechanism 8 for discharging fuel from the pressurizing chamber 11 to a discharge passage to discharge fuel are provided.

The cylinder 6 is press-fitted into the pump body 1 on the outer peripheral side thereof, further deforms the body toward the inner peripheral side in the fixing portion 6*a* to press the cylinder upward in the drawing to seal so as not to leak the fuel pressurized in the pressurizing chamber 11 at the upper end surface of the cylinder 6 to the low pressure side.

At the lower end of the plunger 2, a tappet 92 is provided for converting rotational motion of a cam 93 attached to a camshaft of the internal combustion engine into up-and-down motion and transmitting the motion to the plunger 2. The plunger 2 is crimped to the tappet 92 by a spring 4 via a retainer 15. As a result, the plunger 2 can reciprocate up and down along with the rotational motion of the cam 93.

The plunger seal 13 held at the lower end portion of the inner periphery of the seal holder 7 is disposed in slidable contact with the outer periphery of the plunger 2 at the lower portion of the cylinder 6 in the drawing. Thereby, when the plunger 2 slides, the fuel in an auxiliary chamber 7*a* is sealed and prevented from flowing into the internal combustion engine. At the same time, it prevents a lubricant (including engine oil) lubricating the sliding portion in the internal combustion engine from flowing into the pump body 1.

As illustrated in FIGS. 2 and 3, the suction joint 51 is attached to the side surface portion of the pump body 1 of the high-pressure fuel supply pump. The suction joint 51 is connected to a low pressure pipe that supplies fuel from the fuel tank 20 of a vehicle, and the fuel is supplied to the inside of the high-pressure fuel supply pump from the low pressure pipe. A suction filter 52 serves to prevent foreign matter present between the fuel tank 20 and the low pressure fuel suction port 10*a* from being absorbed into the high-pressure fuel supply pump by the flow of fuel.

The fuel that has passed through the low-pressure fuel intake port 10*a* passes through the low-pressure fuel intake port 10*b* vertically communicating with the pump body 1 illustrated in FIG. 3 toward the pressure pulsation reduction mechanism 9. The outer peripheral edge portion of the pressure pulsation reduction mechanism 9 is disposed so as to ride on a stepped portion formed in the upper opening of the pump body 1. Specifically, in the pump body 1, a stepped portion positioned one level upper than the bottom surface of the upper opening is formed on the circumference, and the stepped portion and the outer peripheral edge portion of the pressure pulsation reduction mechanism 9 are disposed to be in contact with each other. Further, a holding member 9*a* is disposed between the pressure pulsation reduction mechanism 9 and the damper cover 14, and a force generated when the damper cover 14 is attached to the pump body 1 is applied to the holding member 9*a*, whereby the holding member 9*a* presses the pressure pulsation reduction mechanism 9 against the pump body 1.

The pressure pulsation reduction mechanism 9 is formed by overlapping two diaphragms, in which a gas of 0.3 MPa to 0.6 MPa is sealed, and an outer peripheral edge portion thereof is fixed by welding. For this purpose, the outer peripheral edge portion is thin and formed to be thick toward the inner peripheral side. The holding member 9*a* is configured to come into contact with the inner diameter side of the welding portion of the pressure pulsation reduction mechanism 9 to avoid contact with the welded portion. As a result, breakage of the pressure pulsation reduction mechanism 9 due to stress being applied to the welded portion can be prevented.

When the damper cover 14 is press-fitted and fixed to the outer edge portion of the pump body 1, the holding member 9*a* is elastically deformed to support the pressure pulsation reduction mechanism 9. Thus, on the upper and lower surfaces of the pressure pulsation reduction mechanism 9, a damper chamber 10*c* communicating with the low-pressure fuel intake ports 10*a* and 10*b* is formed. Although not illustrated in the drawing, a passage is formed in the holding member 9*a* or in the stepped portion of the pump body 1 to communicate the upper side and the lower side of the pressure pulsation reduction mechanism 9, whereby the damper chamber 10*c* is formed on the upper and lower surfaces of the pressure pulsation reduction mechanism 9.

The fuel that has passed through the damper chamber 10*c* then reaches the suction port 31*b* of the electromagnetic suction valve mechanism 300 via the low-pressure fuel flow path 10*d* formed to communicate with the pump body in the vertical direction. The suction port 31*b* is formed to communicate with the suction valve seat member 31 forming the suction valve seat 31*a* in the vertical direction.

As illustrated in FIG. 2, the discharge valve mechanism 8 provided at the outlet of the pressurizing chamber 11 includes a discharge valve seat 8*a*, a discharge valve 8*b*, a discharge valve spring 8*c*, and a stopper 8*d*. The discharge valve 8*b* moves toward and away from the discharge valve seat 8*a*. The discharge valve spring 8*c* energizes the discharge valve 8*b* toward the discharge valve seat 8*a*. The discharge valve stopper 8*d* determines a stroke (moving distance) of the discharge valve 8*b*. The discharge valve stopper 8*d* and the pump body 1 are joined at a contact portion by welding to shut off a fuel from the outside.

When there is no fuel pressure difference between the pressurizing chamber 11 and a discharge valve chamber 12*a*, the discharge valve 8*b* is crimped to the discharge valve seat 8*a* by energizing force of the discharge valve spring 8*c* and is in a closed state. The discharge valve 8*b* opens against the discharge valve spring 8*c* only when the fuel pressure in the pressurizing chamber 11 becomes larger than the fuel pressure in the discharge valve chamber 12*a*. The high-pressure fuel in the pressurizing chamber 11 is discharged to the common rail 23 via the discharge valve chamber 12*a*, the fuel discharge passage 12*b*, and the fuel discharge port 12. When the discharge valve 8*b* opens, it comes into contact with the discharge valve stopper 8*d*, and the stroke is limited. Therefore, the stroke of the discharge valve 8*b* is appropriately determined by the discharge valve stopper 8*d*. As a result, the stroke is so large that the fuel discharged to the discharge valve chamber 12*a* at a high pressure can be prevented from flowing back into the pressurizing chamber 11 again due to closing delay of the discharge valve 8*b*, and consequently the efficiency reduction of the high-pressure fuel supply pump can be suppressed. When the discharge valve 8*b* repeats valve opening and closing movements, the discharge valve 8*b* guides on the outer peripheral surface of the discharge valve stopper 8*d* so as to move only in the stroke direction. With the above configuration, the discharge valve mechanism 8 becomes a check valve that restricts the flowing direction of the fuel.

As described above, the pressurizing chamber 11 includes a pump body 1, the electromagnetic suction valve mechanism 300, the plunger 2, the cylinder 6, and the discharge valve mechanism 8.

When the plunger 2 moves in the direction of the cam 93 by the rotation of the cam 93 and is in a suction stroke state, the volume of the pressurizing chamber 11 increases, and the fuel pressure in the pressurizing chamber 11 decreases. When the fuel pressure in the pressurizing chamber 11 becomes lower than the pressure of the suction port 31*b* in this process, the suction valve 30 is in an open valve state. When the suction valve 30 reaches the maximum opening degree, the suction valve 30 comes into contact with a stopper 32. When the suction valve 30 opens, the opening formed in the seat member 31 opens. The fuel passes through the opening and flows into the pressurizing chamber 11 through a hole if formed laterally in the pump body 1. The hole if also constitutes a part of the pressurizing chamber 11.

After the plunger 2 finishes the suction stroke, the plunger 2 turns into an upward movement to shift to an upward stroke. Here, an electromagnetic coil 43 is maintained in a non-energized state, and the magnetic biasing force does not act. A rod biasing spring 40 is set so as to bias a rod convex portion 35*a* which is convex toward the outer diameter side of a rod 35 and to have a biasing force necessary and sufficient for keeping the suction valve 30 open in a non-energized state. The volume of the pressurizing chamber 11 decreases with upward movement of the plunger 2, but in this state, once the fuel drawn into the pressurizing chamber 11 is returned to the suction passage 10*d* again through the opening of the suction valve 30 in a valve opening state such that the pressure in the pressurizing chamber never rises. This process is referred to as returning stroke.

In this state, when a control signal from the engine control unit 27 (hereinafter referred to as ECU) is applied to the electromagnetic suction valve mechanism 300, a current flows through a terminal 46 to the electromagnetic coil 43. A magnetic attractive force acts between a magnetic core 39 and an anchor 36 such that the magnetic core 39 and the anchor 36 come into contact with a magnetic attracting surface S. The magnetic attractive force overcomes the biasing force of the rod biasing spring 40 to bias the anchor 36, and the anchor 36 engages with the rod convex portion 35*a* to move the rod 35 in a direction away from the suction valve 30.

At this time, the suction valve 30 is closed by the biasing force of the suction valve biasing spring 33 and the fluid force caused by the fuel flowing into the suction passage 10*d*. After valve closing, the fuel pressure in the pressurizing chamber 11 rises together with the ascending motion of the plunger 2, and when the pressure becomes equal to or higher than the pressure of the fuel discharge port 12, the high-pressure fuel is discharged via the discharge valve mechanism 8, and the high pressure fuel is discharged to the common rail 23. This stroke is referred to as a discharge stroke.

That is, the upward stroke between the lower starting point and the upper starting point of the plunger 2 includes a return stroke and a discharge stroke. By controlling the energization timing of the electromagnetic suction valve mechanism 300 to the coil 43, the amount of the high-pressure fuel to be discharged can be controlled. If the electromagnetic coil 43 is energized earlier, the rate of the return stroke during the compression stroke is small, and the rate of the discharge stroke is large. That is, the amount of fuel returned to the suction passage 10*d* is small, and the amount of fuel discharged at a high pressure is increased. On the other hand, if the energization timing is delayed, the rate of the return stroke during the compression stroke is large, and the rate of the discharge stroke is small. That is, the amount of fuel returned to the suction passage 10*d* is large, and the amount of fuel discharged at a high pressure is reduced. The energization timing of the electromagnetic coil 43 is controlled by a command from the ECU 27. By controlling the conduction timing to the electromagnetic coil 43 as described above, it is possible to control the amount of fuel to be discharged at a high pressure to the amount required by the internal combustion engine.

In the low-pressure fuel chamber 10, a pressure pulsation reduction mechanism 9 for reducing ripple of pressure pulsation generated in the high-pressure fuel supply pump to the fuel pipe 28. Once the fuel that has flown into the pressurizing chamber 11 is returned to the suction passage 10*d* through the suction valve body 30 that is in the open valve state for capacity control, the fuel returned to the suction passage 10*d* causes the pressure pulsation in the low-pressure fuel chamber 10.

However, the pressure pulsation reduction mechanism 9 provided in the low-pressure fuel chamber 10 is formed by a metal diaphragm damper in which two disk-shaped metal plates in a corrugated form are laminated on the outer periphery thereof, and an inert gas such as argon is injected into the inside. The pressure pulsation is absorbed and reduced by expanding/contracting this metal damper.

The plunger 2 has a large-diameter portion 2*a* and a small-diameter portion 2*b*, and the volume of the auxiliary chamber 7*a* is increased or decreased by the reciprocating motion of the plunger. The auxiliary chamber 7*a* communicates with the low-pressure fuel chamber 10 through a fuel passage 10*e*. When the plunger 2 descends, a flow of fuel is generated from the auxiliary chamber 7*a* to the low-pressure fuel chamber 10, and when the plunger 2 rises, a flow of fuel is generated from the low-pressure fuel chamber 10 to the auxiliary chamber 7*a*.

As a result, it is possible to reduce the fuel flow to the inside and outside of the pump during the suction or return stroke of the pump, and a function to reduce the pressure pulsation generated inside the high-pressure fuel supply pump is provided.

Next, a relief valve mechanism 200 illustrated in FIGS. 1 and 2 will be described.

The relief valve mechanism 200 includes a relief body 201, a relief valve 202, a relief valve holder 203, a relief spring 204, and a spring stopper 205. The relief body 201 is provided with a tapered seat portion 201*a*. In the valve 202, the load of the relief spring 204 is loaded via the valve holder 203 and pressed against the seat portion 201*a* to shut off fuel in cooperation with the seat portion 201*a*. A valve opening pressure of the relief valve 202 is determined by the load of the relief spring 204. The spring stopper 205 is press-fitted and fixed to the relief body 201, and is a mechanism that adjusts a load of the relief spring 204 according to a press-fit fixing position.

Here, when the fuel in the pressurizing chamber 11 is pressurized, and the discharge valve 8*b* opens, the high-pressure fuel in the pressurizing chamber 11 passes through the discharge valve chamber 12*a* and the fuel discharge passage 12*b* and is discharged from the fuel discharge port 12. The fuel discharge port 12 is formed in a discharge joint 60, and the discharge joint 60 is welded and fixed to the pump body 1 at a welded portion to secure a fuel passage. In the present embodiment, the relief valve mechanism 200 is disposed in a space formed inside the discharge joint 60. That is, the outermost diameter portion (the outermost diameter portion of the relief body 201 in the present embodiment) of the relief valve mechanism 200 is arranged radially inward of the inner diameter portion of the discharge joint 60, and when the pump body 1 is viewed from the upper side, the relief valve mechanism 200 overlaps at least partly with the discharge joint 60 in its axial direction.

It is desirable that the relief valve mechanism 200 be directly inserted into a hole formed in the pump body 1 and arranged in a non-contact manner with the discharge joint 60. As a result, even if the shape of the discharge joint 60 is changed, it is not necessary to change the shape of the relief valve mechanism 200 in response to this change, and cost reduction can be achieved.

That is, in the present embodiment, as illustrated in FIG. 1, a first hole 1*c* (lateral hole) is formed in the direction orthogonal to the axial direction of the plunger (lateral direction) from the outer peripheral surface of the pump body 1 toward the inner diameter side. The relief valve mechanism 200 is disposed by press-fitting the relief body 201 into the first hole 1*c* (lateral hole). In the present embodiment, when the relief valve mechanism 200 opens in communication with the first hole 1*c* (lateral hole), a second hole 1*d* (lateral hole) for returning the fuel pressurized in the pressurizing chamber 11 in a flow path closer to the discharge side than the discharge valve 8*b* to the pressurizing chamber 11 is formed to the pump body 1. The cross sectional area of the second hole 1*d* (lateral hole) is smaller than the cross sectional area of the first hole 1*c* (lateral hole).

More specifically, when the relief valve 202 opens, the discharge side flow path (fuel discharge port 12) and the internal space of the relief body 201 communicate with each other. The relief valve holder 203, the relief spring 204, and the spring stopper 205 are disposed in the internal space. A hole is formed in the central portion of the spring stopper 205 as viewed in the axial direction of the relief valve, whereby the internal space of the relief body 201 and a relief passage 213 formed by the second hole 1*d* (vertical hole) are connected. An end portion of the relief body 201 on the side where the spring stopper 205 is disposed is an opening. The relief valve 202, the relief valve holder 203, the relief spring 204, and the spring stopper 205 are inserted from the opening in this order, and the relief valve mechanism 200 is formed.

When the relief valve 202 opens, fuel in an internal space of the relief body 201 flows into the pressurizing chamber 11 through the hole at the center of the spring stopper 205, the opening of the relief body 201, and the relief passage 213.

When the high-pressure fuel supply pump operates normally, the fuel pressurized by the pressurizing chamber 11 passes through the fuel discharge passage 12*b* and is discharged from the fuel discharge port 12 at a high pressure. In the present embodiment, the target fuel pressure of the common rail 23 is 35 MPa. The pressure inside the common rail 23 repeats pulsation over time, but the average value is 35 MPa.

Immediately after the start of a pressurizing stroke, the pressure in the pressurizing chamber 11 rises sharply to be higher than the pressure inside the common rail 23 and rises to about 43 MPa as a peak value in the present embodiment. Accordingly, the pressure of the fuel discharge port 12 also rises to about 41.5 MPa at the peak in the present embodiment. In the present embodiment, at the peak, the valve opening pressure of the relief valve mechanism 200 is set to 42 MPa, the pressure of the fuel discharge port 12, which is the entrance of the relief valve mechanism 200, is set so as not to exceed the valve opening pressure, and the relief valve mechanism 200 does not open.

Next, a case where abnormally high pressure fuel is generated will be described.

The pressure of the fuel discharge port 12 becomes abnormally high pressure due to failure of the electromagnetic suction valve 300 of the high-pressure fuel supply pump, when the set pressure of the relief valve mechanism 200 is higher than the set pressure 42 MPa, the abnormally high pressure fuel is relieved to the pressurizing chamber 11 on the low pressure side via the relief passage 213.

In the present embodiment, the pressurizing chamber 11 is a returning destination of the abnormally high pressure fuel by the relief valve mechanism 200, but the present invention is not limited thereto. That is, the returning destination of the abnormally high pressure fuel by the relief valve mechanism 200 may be used as the damper chamber 10*c*.

An advantage of having a configuration to relieve abnormally high pressure fuel on the low pressure side (the damper chamber 10*c* in the present embodiment) will be described. In all steps of the intake stroke, return stroke, and discharge stroke, it is possible to relieve the abnormally high pressure fuel generated due to failure or the like of the high-pressure fuel supply pump to a low pressure. On the other hand, when the pressurizing chamber 11 can relieve abnormally high pressure fuel, it is possible to relieve the abnormally high pressure fuel into the pressurizing chamber 11 only in the intake stroke and the return stroke, and it is impossible to relieve abnormally high pressure fuel in the pressurizing stroke. This is because, since an outlet of the relief valve is the pressurizing chamber 11, in the pressurizing stroke, the pressure in the pressurizing chamber 11 rises, and the differential pressure between an inlet and an outlet of the relief valve does not exceed a set pressure of the relief spring. As a result, the time to relieve the abnormally high pressure fuel is shortened, and the relief function is deteriorated.

In the present embodiment, the relief valve mechanism 200 is assembled externally as a subassembly before being attached to the pump body 1. After the assembled relief valve mechanism 200 is press-fitted and fixed in the pump body 1, the discharge joint 60 is welded and fixed to the pump body 1. In the present embodiment, as illustrated in FIG. 1, the relief valve mechanism 200 disposed in the first hole 1*c* (lateral hole) is disposed at least partly on the pressure chamber side (upper side in FIG. 1) with respect to the uppermost end portion 6*b* on the pressurizing chamber side of the cylinder 6.

In order to secure the thickness of the relief valve mechanism 200 and the pressurizing chamber 11, as illustrated in FIG. 1, it is desirable that all of the relief valve mechanism 200 be disposed above the uppermost end portion 6*b* on the pressurizing chamber side of the cylinder 6.

Further, the center axis of the relief valve mechanism 200, that is, the center axis of the relief body 201, the relief valve holder 203, or the spring stopper 205 is disposed substantially linearly with the central axis of the electromagnetic suction valve mechanism 300 (rod 35). Therefore, the assembly property of the high-pressure fuel supply pump can be improved. The relief valve mechanism 200 can be provided on the same plane as the discharge joint 60, the electromagnetic suction valve mechanism 300, and the discharge valve mechanism 8, such that the workability can be improved in manufacturing the pump body 1.

As described above, the high-pressure fuel supply pump of the present embodiment includes the pump body 1 and the flange portion 1*a*. The pump body 1 forms the pressurizing chamber 11 at an inner wall portion. The flange portion 1*a* fixes the pump body 1 to the high-pressure fuel supply pump mounting portion 90 (cylinder block). Further, the cylinder 6 is inserted into the hole 16*b* of the pump body 1 from the lower side, and the pressurizing chamber 11 is formed further above the uppermost end surface 6*b*. Further, the spring holding member (seal holder 7) has an outer peripheral portion 7*d* press-fitted and fixed to the pump body 1, and a holding portion 7*b* for holding a spring portion 4 that biases the pump body 1 between the outer peripheral portion 7*d* and an inner peripheral portion 7*e*. In the high-pressure fuel supply pump, a spring-side lowermost end portion 7*c* of the holding portion 7*b* of the spring holding member (seal holder 7) is disposed above a lowermost end portion 1*e* of the flange portion 1*a*.

The spring-side lowermost end portion 7*c* of the holding portion 7*b* of the spring holding member (seal holder 7) may be referred to as a spring contact portion.

More specifically, the pump body 1 is provided with a first hole 16*a*, a second hole 16*b*, and a third hole 16*c*. The first hole 16*a* forms the pressurizing chamber 11 and has a first cross-sectional area. The second hole 16*b* communicates with the first hole 16*a*, is formed on the side opposite to the pressurizing chamber 11, and has a second cross sectional area that is larger than the first cross sectional area. The third hole 16*c* communicates with the second hole 16*b*, is formed on the side opposite to the pressurizing chamber 11, and has a third cross sectional area that is larger than the second cross sectional area.

As described above, the cylinder 6 is inserted from the opposite side of the pressurizing chamber 11 toward the pressurizing chamber 11, and the uppermost end surface 6*b* is in contact with the upper end surface of a portion forming the second hole 16*b* of the pump body 1. Further, the spring holding member (seal holder 7) is inserted from the opposite side of the pressurizing chamber 11 toward the pressurizing chamber 11 and is disposed so as to face the portion forming the third hole 16*c* of the pump body 1. In the high-pressure fuel supply pump, the spring-side lowermost end portion 7*c* of the holding portion 7*b* of the spring holding member (seal holder 7) is disposed above the lowermost end portion 1*e* of the flange portion 1*a*.

In the present embodiment, an insertion portion 1*g* to be inserted into the high-pressure fuel supply pump mounting portion 90 (cylinder block) is constituted by a part of the pump body 1, but this insertion portion 1*g* may be formed separately from the pump body 1. In this case, the high-pressure fuel supply pump is provided with an insertion portion 1*g* to be inserted into the high-pressure fuel supply pump mounting portion 90 (cylinder block) and a spring holding member (seal holder 7) which is fixed to the insertion portion 1*g* and holds the spring portion 4 for urging the pump body 1. Although it is different from the configuration of FIGS. 1 and 3, a lower end portion 1*h* of the insertion portion 1*g* or the position of the lower end portion 7*f* of the outer peripheral portion 7*d* of the spring holding member (seal holder 7) may be further extended downward. A high-pressure fuel supply pump is attached to the high-pressure fuel supply pump mounting portion 90 (cylinder block). In a state where the spring portion 4 is contracted, the high-pressure fuel supply pump is configured such that equal to or more than half of the entire length of the spring portion 4 is positioned closer to the pressurizing chamber 11 than the lower end portion 1*h* of the insertion portion 1*g* or the lower end portion 7*f* of the outer peripheral portion 7*d* of the spring holding member (seal holder 7). The cylinder 6 is inserted into the hole 16*c* of the pump body 1 from the lower side, and the pressurizing chamber 11 is formed further above the uppermost end surface 6*b*.

With the above configuration, it is possible to secure a mounting space of the spring portion 4 without increasing the height of the pump body 1.

In this way, the high-pressure fuel supply pump is not attached to the high-pressure fuel supply pump mounting portion 90 (cylinder block). In a state where the spring portion 4 is extended, it is desirable that equal to or more than half of the entire length of the spring portion 4 be positioned on the opposite side to the pressurizing chamber 11 from the lower end portion 1*h* of the insertion portion 1*g* or the lower end portion 7*f* of the outer peripheral portion 7*d* of the spring holding member (seal holder 7).

The spring holding member (seal holder 7) has an inner peripheral portion for holding the plunger seal 13 between the plunger 2 sliding on the inner diameter side of the cylinder 6 and the spring holding member. The inner peripheral portion has a small-diameter inner peripheral portion 7*g* for holding the plunger seal 13 and a large-diameter inner peripheral surface 7*h* facing the outer peripheral surface of the cylinder 6 above the small-diameter inner peripheral portion 7*g*. The cylinder 6 has an upper cylinder large diameter portion and a cylinder small diameter portion below the cylinder large diameter portion, and in the plunger axial direction (vertical direction in FIGS. 1 and 3), it is desirable that the spring holding member (seal holder 7) be disposed such that the large-diameter inner peripheral portion 7*h* and the cylinder small-diameter portion of the cylinder 6 overlap each other. Also, it is desirable that the maximum diameter on the outer diameter side of the cylinder small diameter portion be set to be a ratio of ½ to 1 with respect to the maximum diameter on the outer diameter side of the cylinder large diameter portion.

Further, as illustrated in FIGS. 1 and 3, in a direction orthogonal to the plunger axial direction, it is disposed such that the thickness (horizontal direction) of the cylinder small diameter portion is larger than a gap between the large-diameter inner peripheral portion 7*h* of the spring holding member (seal holder 7) and the cylinder small diameter portion. It is desirable that the outermost diameter portion of the large-diameter inner peripheral portion 7*h* of the spring holding member (seal holder 7) be disposed on the further outer diameter side of the outermost diameter portion of the cylinder insertion hole 16*c* into which the cylinder 6 is inserted. In the axial direction of the plunger, it is desirable that the large-diameter inner peripheral portion 7*h* of the inner peripheral portion of the spring holding member (seal holder 7) overlap with the cylinder small diameter portion of the cylinder 6.

Further, as illustrated in FIGS. 1 and 3, the pump body 1 is convex toward the inner diameter side on the lower side of the cylinder 6, a convex portion 1*i* for supporting the lower end (fixed portion 6*a*) of the cylinder 6 is formed, and it is desirable that the innermost diameter portion of the convex portion 1*i* be disposed on the further inner diameter side of the outermost diameter portion 7*i* of the large-diameter inner peripheral portion 7*h* of the spring holding member (seal holder 7). The spring holding member (seal holder 7) is desirably formed of a pressed metal plate. As a result, the spring holding member (seal holder 7) can be manufactured at low cost.

However, since increasing the pressure is required more and more in the future, the biasing force of the spring portion 4 also increases. Therefore, the strength of the spring holding member (seal holder 7) or the press fit accuracy may be a problem. In this case, it is conceivable that the strength of the spring holding member (seal holder 7) is ensured due to manufacturing not by pressing the spring holding member but by cutting processing of the metal member. Therefore, it is possible to maintain the strength by cutting the thickness of the holding portion 7*b* so as to be thicker than the thickness of the outer peripheral portion 7*d* and the inner peripheral portion 7*e*. In this case, besides a method of fixing the spring holding member (seal holder 7) by press fitting into the third hole 16*c* of the pump body 1, a method of fixing by forming a female screw in the third hole 16*c* of the pump body 1 and forming a male screw on the outer peripheral portion 7*d* is considered. This makes it possible to improve the fixing accuracy.

Further, it is desirable that the spring holding member (seal holder 7) be inserted from the opposite side of the pressurizing chamber 11 toward the pressurizing chamber 11 and disposed so as to be in contact with the facing portion of the third hole 16*c* of the pump body 1. In the future, further increase in pressure is assumed, but then a spring load of the spring portion 4 also increases. Therefore, by fixing by further pushing the spring holding member (seal holder 7) toward the pressurizing chamber 11 side and bringing it into contact with the opposing portion of the third hole 16*c*, the spring holding member (seal holder 7) can be stably held. Even in that case, it is necessary to communicate the seal chamber (auxiliary chamber 7*a*) whose volume increases and decreases due to the vertical movement of the plunger 2 and the damper chamber 10*c*. Therefore, a flow path for communicating the seal chamber (auxiliary chamber 7*a*) and the damper chamber 10*c* is formed in the spring holding member (seal holder 7).

That is, the spring holding member (seal holder 7) includes an inner peripheral portion to hold the plunger seal 13 between the inner peripheral portion and the plunger 2, and a cutout portion or a recessed portion communicating between a space formed opposite to the third hole 16*c* and a space formed by the plunger seal 13.

REFERENCE SIGNS LIST

1 pump body
2 plunger
6 cylinder
7 seal holder
8 discharge valve mechanism
9 pressure pulsation reduction mechanism
10*a* low pressure fuel suction port
11 pressurizing chamber
12 fuel discharge port
13 plunger seal
30 suction valve
40 rod biasing spring
43 electromagnetic coil
200 relief valve
201 relief body
202 valve holder
203 relief spring
204 spring stopper
300 electromagnetic suction valve mechanism

The invention claimed is:

1. A high-pressure fuel supply pump system comprising:
a pump body configured to form a pressurizing chamber at an inner wall portion; and
a flange portion configured to fix the pump body to a mounting portion for a high-pressure fuel supply pump within an internal combustion engine;
wherein the high-pressure fuel supply pump comprises:
a cylinder which is inserted into a hole portion of the pump body from a lower side and in which the pressurizing chamber is formed further above an uppermost end surface;
a plunger disposed to slide on an inner diameter side of the cylinder; and
a spring holding member having an outer peripheral portion press-fitted and fixed to the pump body and a holding portion holding a spring portion for biasing the plunger on a radially inner side of the outer peripheral portion; and
wherein a spring contact portion of the spring holding member is disposed above a lowermost end portion of the flange portion.

2. A high-pressure fuel supply pump system comprising:
a pump body configured to form a pressurizing chamber at an inner wall portion; and
a flange portion configured to fix the pump body to a mounting portion for a high-pressure fuel supply pump within an internal combustion engine;
wherein the pump body is provided with a first hole having a first cross sectional area forming the pressurizing chamber, a second hole communicating with the first hole, being formed on the side opposite to the pressurizing chamber, and having a second cross sectional area larger than the first cross sectional area, and a third hole communicating with the second hole, being formed on the side opposite to the pressurizing chamber, and having a third cross sectional area larger than the second cross sectional; and wherein the high-pressure fuel supply pump comprises:

a cylinder which is inserted from an opposite side of the pressurizing chamber toward the pressurizing chamber and whose uppermost end surface is in contact with an upper end surface of a portion forming the second hole of the pump body;

a plunger disposed to slide on an inner diameter side of the cylinder; and a spring holding member which has a holding portion holding a spring portion for biasing the plunger and is inserted from the opposite side of the pressurizing chamber toward the pressurizing chamber and is configured to face a portion forming the third hole of the pump body;

wherein a spring contact portion of the spring holding member is disposed above a lowermost end portion of the flange portion; and wherein the spring portion is configured to contact the spring contact portion.

3. A high-pressure fuel supply pump system comprising:

a pump body configured to form a pressurizing chamber at an inner wall portion; and a flange portion configured to fix the pump body to a mounting portion for a high-pressure fuel supply pump within an internal combustion engine;

wherein the high-pressure fuel supply pump comprises:

an insertion portion inserted into the mounting portion;

a plunger disposed to slide on an inner diameter side of a cylinder; and a spring holding member having an outer peripheral portion fixed to the insertion portion and a holding portion holding a spring portion for biasing the plunger on the radially inner side of the outer peripheral portion;

wherein when the high-pressure fuel supply pump is attached to the mounting portion, in a state where the spring portion is contracted, half or more of the entire length of the spring portion is positioned closer to the pressurizing chamber side than a lower end portion of the insertion portion or a lower end portion of the outer peripheral portion of the spring holding member;

wherein a spring contact portion of the spring holding member that is a lowermost end portion of the spring holding member is disposed above a lowermost end portion of the flange portion; and wherein the spring contact portion is configured to contact the spring-side lowermost end portion.

4. The high-pressure fuel supply pump system according to claim 3, wherein the cylinder is inserted into a hole portion of the pump body from a lower side and in which the pressurizing chamber is formed further above an uppermost end surface.

5. The high-pressure fuel supply pump system according to claim 3, wherein when the high-pressure fuel supply pump is not attached to the mounting portion, and in a state where the spring portion is extended, half or more of the entire length of the spring portion is positioned on an opposite side to the pressurizing chamber from a lower end portion of the insertion portion or a lower end portion of the outer peripheral portion of the spring holding member.

6. The high-pressure fuel supply pump system according to claim 1, wherein the spring holding member has an inner peripheral portion holding a plunger seal between the plunger sliding on the inner diameter side of the cylinder and the inner peripheral portion; and wherein the inner peripheral portion has a small inner peripheral portion holding the plunger seal and a large diameter inner peripheral portion opposed to an outer peripheral surface of the cylinder above the small diameter inner peripheral portion.

7. The high-pressure fuel supply pump system according to claim 1, wherein the spring holding member has an inner peripheral portion holding a plunger seal between the plunger sliding on the inner diameter side of the cylinder and the inner peripheral portion;

wherein the inner peripheral portion includes a lower small diameter inner peripheral portion and a large diameter inner peripheral portion above the small diameter inner peripheral portion;

wherein the cylinder has an upper cylinder large diameter portion and a cylinder small diameter portion below the cylinder large diameter portion and wherein the large diameter inner peripheral portion of the spring holding member and the cylinder small diameter portion of the cylinder overlap each other in a plunger axial direction.

8. The high-pressure fuel supply pump system according to claim 7, wherein a maximum diameter of the outer diameter side of the cylinder small diameter portion is set to be a ratio of ½ to 1 with respect to a maximum diameter on the outer diameter side of the cylinder large diameter portion.

9. The high-pressure fuel supply pump system according to claim 7, wherein a thickness of the cylinder small diameter portion is larger than a gap between the large diameter inner peripheral surface of the spring holding member and the cylinder small diameter portion in a direction orthogonal to the plunger axial direction.

10. The high-pressure fuel supply pump system according to claim 1, wherein the spring holding member has an inner peripheral portion holding a plunger seal between the plunger sliding on the inner diameter side of the cylinder and the inner peripheral portion;

wherein the inner peripheral portion includes a lower small diameter inner peripheral portion, and a large diameter inner peripheral portion above the small diameter inner peripheral portion; and wherein an outermost diameter portion of the large diameter inner peripheral portion of the spring holding member is disposed on a further outer diameter side of the outermost diameter portion of a cylinder insertion hole into which the cylinder is inserted.

11. The high-pressure fuel supply pump system according to claim 10, wherein the large diameter inner peripheral portion of the inner peripheral portion of the spring holding member and the cylinder small diameter portion of the cylinder overlap each other in a plunger axial direction.

12. The high-pressure fuel supply pump system according to claim 1, wherein the spring holding member has an inner peripheral portion holding a plunger seal between the plunger sliding on the inner diameter side of the cylinder and the inner peripheral portion;

wherein the inner peripheral portion includes a lower small diameter inner peripheral portion and a large diameter inner peripheral portion above the small diameter inner peripheral portion;

wherein the pump body is convex toward the inner diameter side on the lower side of the cylinder forming a convex portion for supporting the lower end of the cylinder; and wherein the innermost diameter portion of the convex portion is disposed on a further inner diameter side of the outermost diameter portion of the large diameter inner peripheral portion of the spring holding member.

13. The high-pressure fuel supply pump system according to claim 1, wherein the spring holding member is formed of a pressed metal plate.

14. The high-pressure fuel supply pump system according to claim 1, wherein the spring holding member is formed of a metal member cut.

15. The high-pressure fuel supply pump system according to claim 2, wherein the spring holding member is inserted from the opposite side of the pressurizing chamber toward the pressurizing chamber and configured to contact a facing portion of the third hole of the pump body.

16. The high-pressure fuel supply pump system according to claim 15, wherein the spring holding member comprises:

an inner peripheral portion holding a plunger seal between the inner peripheral portion and the plunger; and a cutout portion or a recessed portion communicating between a space formed opposite to the third hole and a space formed by the plunger seal.

17. The high-pressure fuel supply pump system according to claim 1, wherein the flange portion is integrally formed within the pump body.

* * * * *